United States Patent [19]

Nash

[11] Patent Number: 4,632,583

[45] Date of Patent: Dec. 30, 1986

[54] FLEXIBLE LEADER

[75] Inventor: Dennis P. Nash, Deerfield Beach, Fla.

[73] Assignee: International Business Machines Corporation, Armonk, N.Y.

[21] Appl. No.: 656,816

[22] Filed: Oct. 1, 1984

[51] Int. Cl.[4] ..... B41J 35/04

[52] U.S. Cl. ..... 400/248; 400/196.1; 400/216.1; 400/217; 400/240

[58] Field of Search ..... 400/194, 195, 196, 196.1, 400/207, 208, 208.1, 211, 212, 214, 216.1, 216.3, 216.5, 217, 217.1, 234, 235, 235.1, 248, 248.1, 248.2, 248.3, 240, 240.4

[56] References Cited

U.S. PATENT DOCUMENTS

| | | | |
|---|---|---|---|
| 2,890,619 | 6/1959 | Waller | 400/248 X |
| 3,318,429 | 5/1967 | Burns et al. | 400/248 X |
| 3,850,358 | 11/1974 | Nettles | 400/208 X |
| 4,047,608 | 9/1977 | Willcox | 400/208 |
| 4,203,676 | 5/1980 | Hatsell | 400/208 |
| 4,277,187 | 7/1981 | Rello | 400/248 |
| 4,284,364 | 8/1981 | Rello | 400/196.1 X |
| 4,290,704 | 9/1981 | Matthias | 400/248 |
| 4,319,850 | 3/1982 | Rello et al. | 400/208 X |
| 4,339,211 | 7/1982 | Alexander et al. | 400/248 |
| 4,413,920 | 11/1983 | Matthias et al. | 400/248 |
| 4,437,779 | 3/1984 | Goff, Jr. et al. | 400/208 |
| 4,469,456 | 9/1984 | Fitzgerald | 400/248 X |
| 4,486,107 | 12/1984 | Willcox | 400/208 |

FOREIGN PATENT DOCUMENTS

| | | | |
|---|---|---|---|
| 2019648 | 11/1971 | Fed. Rep. of Germany | 400/248 |

*Primary Examiner*—Ernest T. Wright, Jr.
*Attorney, Agent, or Firm*—Barbara A. McDowell; Richard E. Bee; Maurice H. Klitzman

[57] ABSTRACT

An improved flexible leader for use in conveying ink ribbon from a ribbon box to the print point of a printer or typewriter is disclosed. The leader is a U-shaped channel with top latches which protects the ribbon from operator contact and provides good ribbon tracking. Vertical raised ridges on the insides of the channel reduce frictional contact between the ribbon and the leader. The leader is easy to install.

10 Claims, 12 Drawing Figures

11
13
15
16
17
18
19
20
22
23
27
33
34
36
37
38
39
41
42
43
46'
47
48

FLEXIBLE LEADER

BACKGROUND OF THE INVENTION

This invention relates to the handling of a ribbon or tape. More specifically, it relates to the transport of ribbon or tape from the ribbon box to the print point in a typewriter, dot matrix printer, or serial impact printer.

A typewriter as well as other forms of printers typically includes provision for relative motion between the impact means and the print receiving means so that the characters may be printed along a line. Commonly, in older style typewriters, the print receiving medium is moved with respect to the character elements which remain stationary. The paper and platen move with respect to the frame of the machine while the character elements are substantially fixed. In modern typewriters and printers the print elements are typically moved with respect to the platen. Since the mechanical operations are the limiting factor in the speed of such machines, a reduction in the inertia of moving parts allows an increase in speed. Thus, it is desirable to move the print element rather than the platen since the former is generally lighter in weight.

It is also desirable that the printing ribbon which passes between the print receiving means and the character elements be stored in a stationary position with respect to the frame of the machine again allowing a reduction in the inertia of moving parts. This has led to the use of flexible leaders which guide the printing ribbon between a stationary ribbon cartridge and movable print point. In order for these leaders to function properly it is necessary that they bend in one direction only so that the ink side of the ribbon will not contact the leader where the leader forms an enclosed channel. It is also important to reduce frictional load between the ribbon and the leader. Furthermore, the leader must be flexible enough in the vertical direction to allow for movement in that direction when multi-colored ribbons are used. Also, the leader must provide good ribbon tracking. Finally, the leader must protect the ribbon from operator contact and be easy to install.

SUMMARY OF THE INVENTION

It is an object of this invention to provide an improved leader of the type which may be used to guide ribbon between the stationary ribbon cartridge and a location movable with respect to the ribbon cartridge.

It is another object of this invention to improve the leader by reducing the frictional load between the ribbon and the leader while maintaining adequate leader flexibility in the vertical direction.

It is a further object of this invention to provide good ribbon tracking.

It is another object of this invention to improve the leader so that the ribbon is protected from operator contact.

It is a still further object of this invention to provide a leader which is easy to install.

In accordance with these and other objects of the invention, the flexible leader comprises a U-shaped channel constructed so that bending of the channel occurs in one direction only. The inside of the channel has vertical raised ridges. The ridges reduce contact between the ribbon and the leader which can result in frictional drag and rubbing off of the ink on the ribbon. The channel has a series of top latches. The shape of the leader and the top latches provide good ribbon tracking and protect the ribbon from operator contact. Simple attachment means at the ends of the leaders allow easy installation.

BRIEF DESCRIPTION OF THE DRAWING

The present invention will be better understood by referring to the accompanying drawing, in which.

DESCRIPTION OF THE PREFERRED EMBODIMENTS

Figure 1:
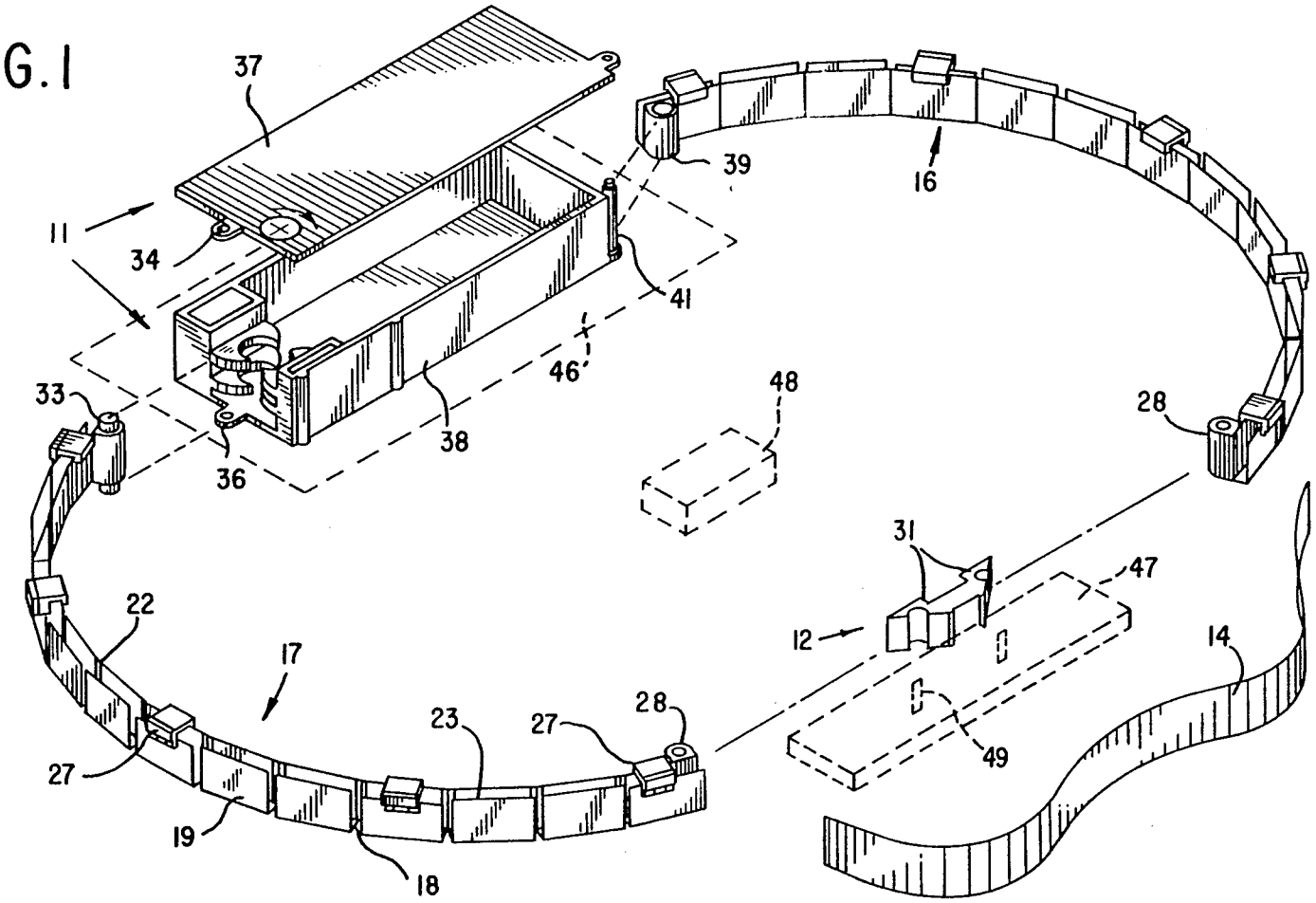
FIG. 1 is an exploded view of the ribbon supply apparatus for a one color ribbon.

Referring now to FIG. 1, one embodiment of the ribbon supply apparatus in a printer according to the present invention is shown. Ribbon box 11 holding a supply of ribbon 14 is mounted on the main frame 46 of the printer 46 and remains stationary during operation. Nosepiece 12 is mounted on the movable printhead carrier 47 and positions ribbon 14 between the print element or printhead 48 and the recording medium (not shown). The ribbon path length is maintained constant by a first flexible leader 16 which extends from ribbon box 11 to nosepiece 12 and a second flexible leader 17 which extends from nosepiece 12 to ribbon box 11. The nosepiece ends of the flexible leaders 16 and 17 move back and forth with the nosepiece 12 during printing operations. The flexible nature of leaders 16 and 17 permits this.

Figure 5:
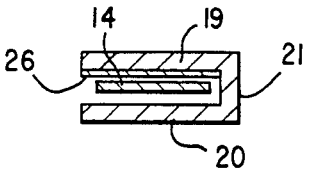
FIG. 5 is a sectional view taken along line 5—5 of FIG. 3.
Figure 6:
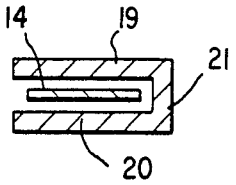
FIG. 6 is a sectional view taken along line 6—6 of FIG. 3.
Figure 7:
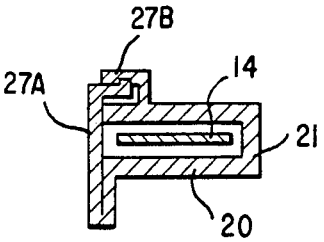
FIG. 7 is a sectional view taken along line 7—7 of FIG. 3.

Referring now to FIGS. 5–7, it will be seen that flexible leaders 16 and 17 are of generally U-shaped construction and ribbon 14 rides inside the leaders 16 and 17 in the manner indicated. In order to increase the flexibility of flexible leaders 16 and 17, vertical slits 18 are cut through outer wall 19 and bottom wall 21 of the U-shaped channel. Inner wall 20 is continuous. These slits 18 create leader hinge points 22 so that flexible leaders 16 and 17 are discontinuous and comprise a series of short, relatively rigid sections 23.

Figures 2A, 2B, 2C:
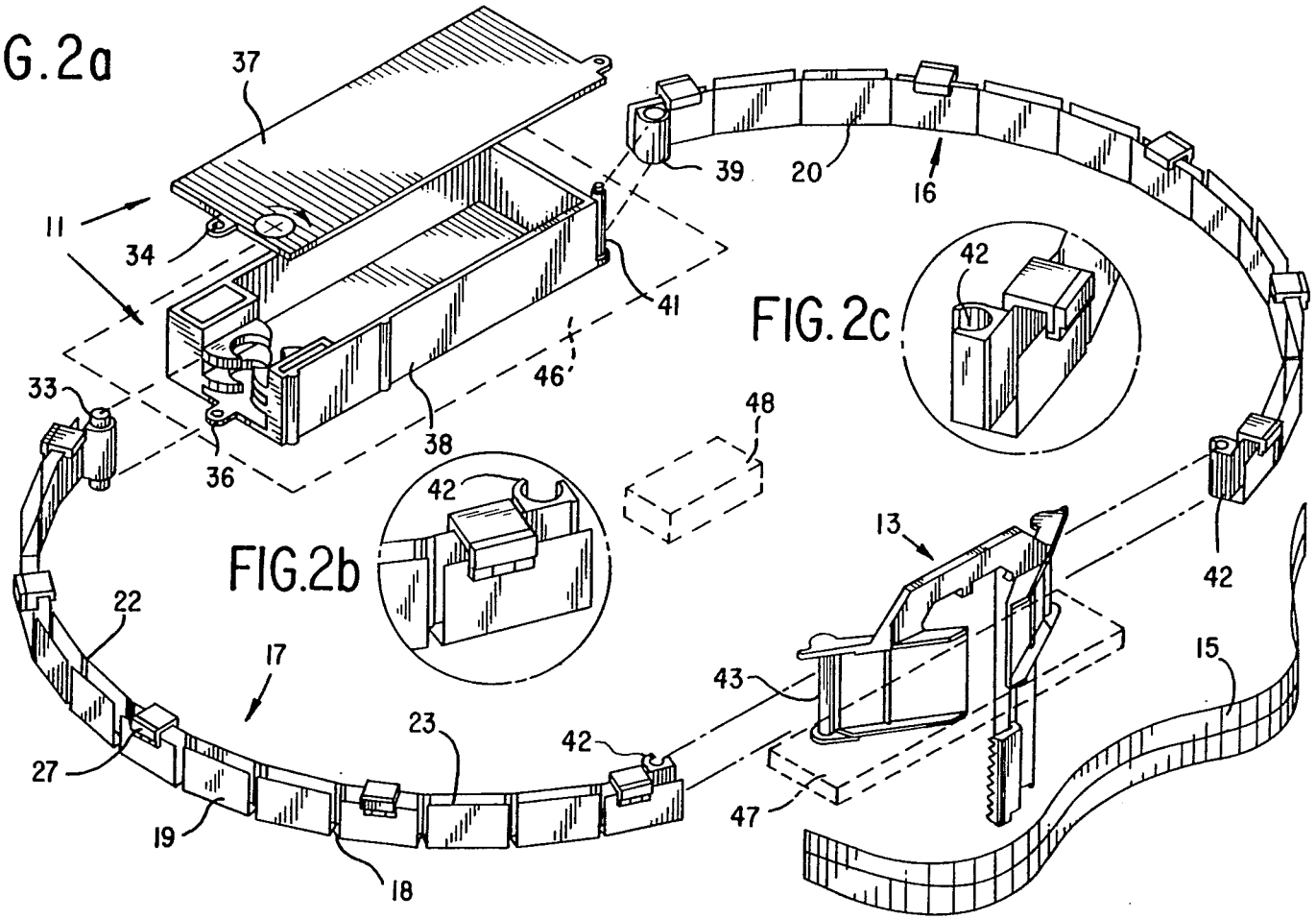
FIG. 2*a* is an exploded view of the ribbon supply apparatus for a multi-color ribbon.
FIGS. 2*b* and 2*c* are enlarged views of the nosepiece attachment ends of FIG. 2*a*.
Figure 3:
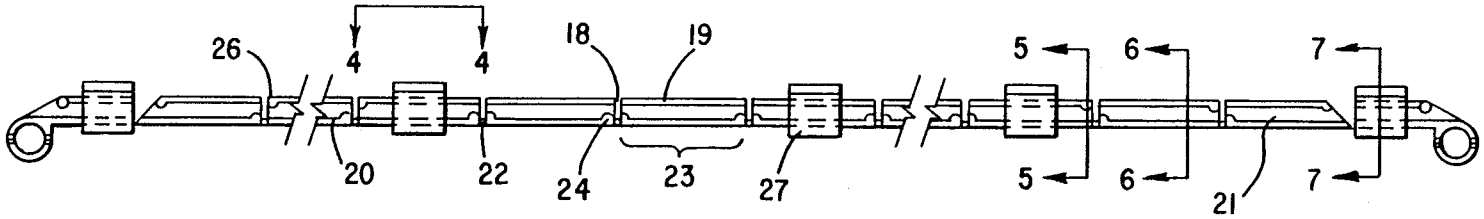
FIG. 3 is a top view of the flexible leader.
Figure 8:
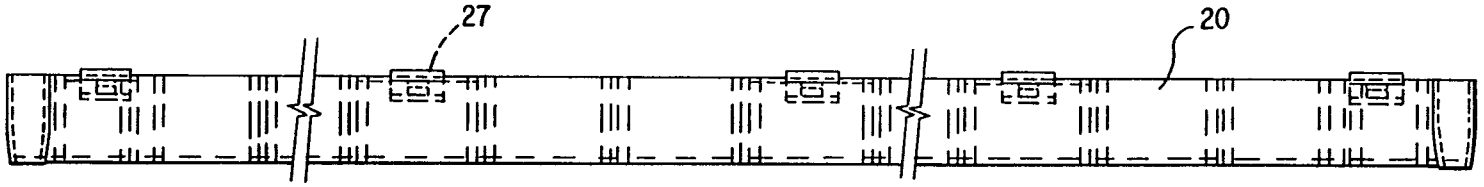
FIG. 8 is a side view of the flexible leader.
Figure 4:
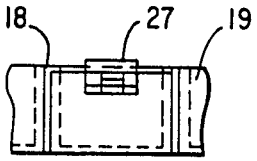
FIG. 4 is a sectional view taken along line 4—4 of FIG. 3.

Referring now to FIG. 3, the insides of one or both of the vertical walls 19,20 of the flexible leaders 16 and 17 have vertical ridges 24,26. Inner wall ridges 24 reduce frictional drag between ribbon 14 and inner wall 20 as the ribbon 14 moves along the center passageway of the flexible leader 16 or 17. Because of the outward flexure of flexible leaders 16 and 17, ribbon 14 will tend to rub against outer wall 19 in the areas opposite leader hinge points 22. Outer wall ridges 26 minimize contact between outer wall 19 and the inked side of the ribbon 14 so that the ink does not tend to rub off on leaders 16 and 17. When multi-colored ribbon 15 is used (as shown in FIG. 2) the ends of flexible leaders 16 and 17 attached to nosepiece 13 must move up and down with nosepiece 13 as it selects the proper color track. Therefore, the ridges 24,26 are vertical to allow good flexibility in the vertical direction of the leader 16 or 17 when it is used with a multi-colored ribbon 15.

Figure 9A:
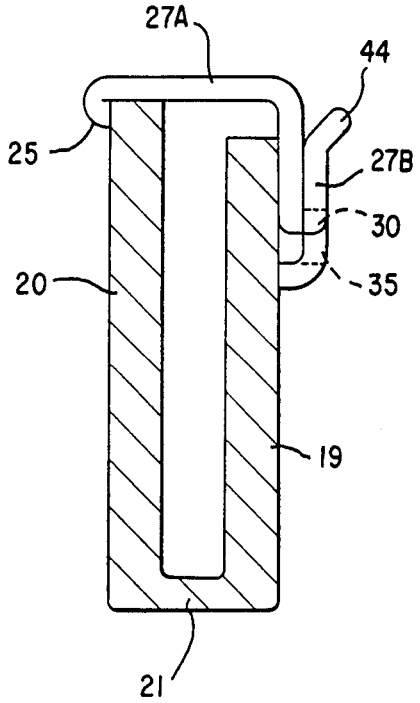
FIGS. 9A and 9B are cross-sectional views of the leader with the top latch in open and closed positions, respectively.
Figure 9B:
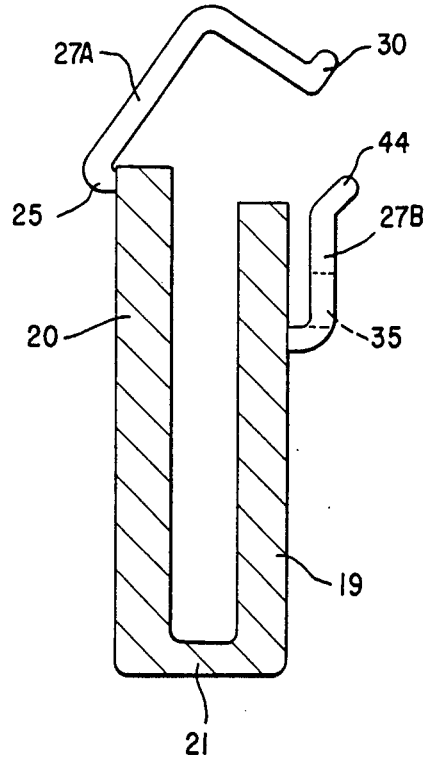

Small top latches 27 are provided on every third segment of flexible leaders 16 and 17. These latches 27 keep the ribbon 14 or 15 from coming out of the U-shaped track. This is especially important when a multi-colored ribbon 15 is used which is raised and lowered during printing depending on the color track selected. In addition, they keep the ribbon 14 or 15 away from the operator. These latches 27 can be opened and closed. (See FIGS. 9A and 9B) Flexible leaders 16 and 17 are single molded pieces of plastic material. Thus, the top latches 27 are an integral part of the molded pieces. The molded material is thinner at latch hinge points 25. This allows upper portion 27*a* of latch 27 to pivot about latch hinge point 25 between open and closed positions. Foot 30 on upper portion 27*a* snaps into opening 35 on lower portion 27*b* of latch 27 to close the latch 27. Top latch 27 can be opened by applying pressure on lip 44 to flex lower portion 27*b* of latch 27 away from outer wall 19. This releases foot 30 from opening 35 in lower portion 27*b* of latch 27.

Flexible leaders 16 and 17 are designed for easy installation. As shown in FIGS. 1 and 2*a, b, c,* attachment of the flexible leaders 16 and 17 to nosepiece 12 (in FIG. 1) or 13 (in FIG. 2) and to ribbon box 11 can be by a variety of means.

In FIG. 1, hollow cylindrical endposts 28 formed at the ends of flexible leaders 16 and 17 are inserted into corresponding cylindrical passageways 31 in nosepiece 12. The combination is then slid down onto vertical mounting posts 49 on the print head carrier 47. Attachment to ribbon box 11 can be by means of mounting post 33 on leader 17 which engages apertures 34 and 36 on top 37 and bottom 38 of ribbon box 11, respectively. Alternatively, attachment to ribbon box 11 can be by means of a second hollow cylindrical endpost 39 which fits on mounting post 41 on ribbon box 11.

In FIG. 2*a,* attachment of flexible leaders 16 and 17 to ribbon box 11 is the same as in FIG. 1. However, the attachment of the leaders 16 and 17 to nosepiece 13 is different. In this embodiment, flexible leaders 16 and 17 are provided with slotted sleeves 42 which snap onto mounting bars 43 on nosepiece 13. (See FIGS. 2*b* and 2*c*)

The entire ribbon supply apparatus is easy and inexpensive to produce. As such it can be used as a throw-away item. The ribbon supply apparatus can be provided with the ribbon 14 or 15 already inserted in the flexible leaders 16 and 17. The installation of a new ribbon 14 or 15 is then a simple matter of snapping ribbon box 11 onto the printer frame 46 and attaching endposts 28 or slotted sleeves 42 of flexible leaders 16 and 17 to nosepiece 12 or 13. As already explained, the attachment of flexible leaders 16 or 17 to the nosepiece 12 or 13 is a simple matter of sliding or snapping corresponding mating parts together. Since the improved design of the flexible leader 16 and 17 almost totally encases ribbon 14 or 15, the operator does not come in contact with the ribbon 14 or 15 and "clean hands" installation is achieved.

While the invention has been particularly shown and described with reference to the preferred embodiments thereof, it will be understood by those skilled in the art that various changes in form and detail and in applying the concepts of the invention may be made without departing from the spirit or scope thereof.

I claim:

1. A flexible leader for guiding a ribbon in a ribbon supply apparatus comprising:

a U-shaped channel having two sides and a bottom wherein a first one of the sides is continuous and a second one of the sides and the bottom are discontinuous so that bending of the channel occurs in one direction only; and a plurality of substantially vertical raised ridges on the inside of at least one of the sides of the channel whereby frictional contact between the ribbon and the leader is reduced without a reduction in the flexibility of the leader.

2. A flexible leader for guiding a ribbon in a ribbon supply apparatus comprising:

a U-shaped channel having two sides and a bottom wherein a first one of the sides is continuous and a second one of the sides and the bottom are discontinuous so that bending of the channel occurs in one direction only; and a plurality of top latches connecting the two sides of the channel whereby the flexible leader achieves good ribbon tracking and protects the ribbon from contact with anything other than the leader.

3. The apparatus of claim 2 additionally comprising a plurality of substantially vertical raised ridges on the inside of at least one of the sides of the channel whereby frictional contact between the ribbon and the leader is reduced without a reduction in the flexibility of the leader.

4. A printing apparatus of the type having a laterally movable print location, a ribbon, a ribbon supply means, and support means for positioning the ribbon adjacent to the print location, the apparatus comprising:

a U-shaped flexible leader having two sides and a bottom wherein a first one of the sides and the bottom are discontinuous so that bending of the leader occurs in one direction only; and a plurality of substantially vertical raised ridges on the inside of at least one of the sides of the channel whereby frictional contact between the ribbon and the leader is reduced without a reduction in the flexibility of the leader.

5. A printing apparatus of the type having a laterally movable print location, a ribbon, a ribbon supply means, and support means for positioning the ribbon adjacent to the print location, the apparatus comprising:

a U-shaped flexible leader having two sides and a bottom wherein a first one of the sides is continuous and a second one of the sides and the bottom are discontinuous so that bending of the leader occurs in one direction only;

a plurality of top latches connecting the two sides of the leader wherein the U-shaped flexible leader and the top latches provide good ribbon tracking and protect the ribbon from contact with anything other than the leader; and attachment means for attaching the flexible leader to the ribbon supply means and the support means.

6. The apparatus of claim 5 additional comprising a plurality of substantially vertical raised ridges on the inside of at least one of the sides of the flexible leader whereby frictional contact between the ribbon and the leader is reduced without a reduction in the flexibility.

7. The apparatus of claim 5 or 6 wherein the attachment means for attaching the flexible leader to the support means is a hollow cylindrical endpost which is inserted into a corresponding cylindrical passageway in the support means.

8. The apparatus of claim 5 or 6 wherein the attachment means for attaching the flexible leader to the support means is a slotted sleeve which snaps onto a mounting bar on the support means.

9. The apparatus of claim 5 or 6 wherein the ribbon supply means has top and bottom portions having apertures and the attachment means for attaching the flexible leader to the ribbon supply means is a mounting post which engages the apertures in the top and bottom of the ribbon supply means.

10. The apparatus of claim 5 or 6 wherein the attachment means for attaching the flexible leader to the ribbon supply means is a hollow cylindrical endpost which fits onto a mounting post on the ribbon supply means.

* * * * *